US011549342B2

(12) United States Patent
Greci et al.

(10) Patent No.: US 11,549,342 B2
(45) Date of Patent: Jan. 10, 2023

(54) GRAVEL PACK ASSEMBLIES AND METHODS TO BYPASS A FLUID RESTRICTOR DURING GRAVEL PACKING OPERATIONS

(71) Applicant: Halliburton Energy Services, Inc., Houston, TX (US)

(72) Inventors: Stephen Michael Greci, Little Elm, TX (US); Michael Linley Fripp, Carrollton, TX (US); Caleb Thomas Warren, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 439 days.

(21) Appl. No.: 16/484,079

(22) PCT Filed: Dec. 18, 2018

(86) PCT No.: PCT/US2018/066317
§ 371 (c)(1),
(2) Date: Aug. 6, 2019

(87) PCT Pub. No.: WO2020/131041
PCT Pub. Date: Jun. 25, 2020

(65) Prior Publication Data

US 2021/0404297 A1 Dec. 30, 2021

(51) Int. Cl.
*E21B 43/04* (2006.01)
*E21B 43/12* (2006.01)

(52) U.S. Cl.
CPC ..... *E21B 43/04* (2013.01); *E21B 43/12* (2013.01)

(58) Field of Classification Search
CPC ..... E21B 43/04; E21B 43/12
See application file for complete search history.

(56) References Cited

U.S. PATENT DOCUMENTS 7,708,068 B2 * 5/2010 Hailey, Jr. ..... E21B 34/08 166/278
8,322,426 B2 12/2012 Wright et al.
(Continued)

OTHER PUBLICATIONS

International Search Report and Written Opinion dated Sep. 18, 2019 issued in International Patent Application No. PCT/US2018/066317.

*Primary Examiner* — Nicole Coy
(74) *Attorney, Agent, or Firm* — McGuireWoods LLP

(57) ABSTRACT

The disclosed embodiments include gravel pack assemblies, method to bypass a fluid restrictor during gravel packing operations, and methods to control fluid flow during and after gravel packing operations. In one embodiment, a gravel pack assembly including a flow restrictor that is coupled to a downhole string that is deployed in a borehole is disclosed. The flow restrictor forms a first fluid passageway from the borehole to an internal cavity of the string. The gravel pack assembly includes a fluid bypass portion having a first chamber, a sealing member inserted into the first chamber; and an actuation assembly operable to actuate the sealing member. The fluid bypass portion forms a second fluid passageway from the borehole to the internal cavity of the downhole string prior to actuation of the actuation assembly. After actuation of the actuation assembly, fluid flow through the second fluid passageway is restricted by the sealing member.

20 Claims, 5 Drawing Sheets

(56) References Cited

U.S. PATENT DOCUMENTS

| | | | | |
|---|---|---|---|---|
| 9,187,991 | B2 * | 11/2015 | Fripp | E21B 43/14 |
| 9,540,912 | B2 * | 1/2017 | Fripp | E21B 34/063 |
| 9,816,352 | B2 * | 11/2017 | Pickle | E21B 34/10 |
| 2007/0246213 | A1 | 10/2007 | Hailey, Jr. | |
| 2009/0151925 | A1 | 6/2009 | Richards et al. | |
| 2010/0084133 | A1 | 4/2010 | Weirich et al. | |
| 2013/0186626 | A1 | 7/2013 | Aitken et al. | |
| 2015/0308238 | A1 * | 10/2015 | Langlais | E21B 43/04 166/278 |
| 2016/0215595 | A1 | 7/2016 | Lopez et al. | |

* cited by examiner

GRAVEL PACK ASSEMBLIES AND METHODS TO BYPASS A FLUID RESTRICTOR DURING GRAVEL PACKING OPERATIONS

BACKGROUND

The present disclosure relates generally to gravel pack assemblies, method to bypass a fluid restrictor during gravel packing operations, and methods to control fluid flow during and after gravel packing operations.

A gravel packing operation is sometimes performed prior to commencement of a hydrocarbon production operation to reduce the amount of unwanted formation sand that may flow into downhole strings (such as production strings) that are deployed in a borehole during the hydrocarbon production operation. During a gravel packing operation, a fluid containing gravel pack slurry is pumped into a production zone of the borehole. After the gravel pack slurry is pumped into the production zone, the gravel pack slurry is dehydrated to form gravel packs around future production regions and to inhibit sand flow into the downhole strings.

Fluid restrictors, such as inflow control devices (ICDs) and autonomous inflow control devices (AICDs), are sometimes coupled to downhole strings that are deployed in a hydrocarbon well to facilitate uniform fluid flow throughout the downhole strings during hydrocarbon production operations. However, fluid restrictors inherently inhibit fluid flow, including fluid flow of the gravel pack slurries during gravel packing operations, which in turn causes insufficient dehydration of the gravel pack slurries, and may result in voids of gravel packs around desired regions of the downhole strings.

BRIEF DESCRIPTION OF THE DRAWINGS

Illustrative embodiments of the present disclosure are described in detail below with reference to the attached drawing figures, which are incorporated by reference herein, and wherein.

Figure 1:
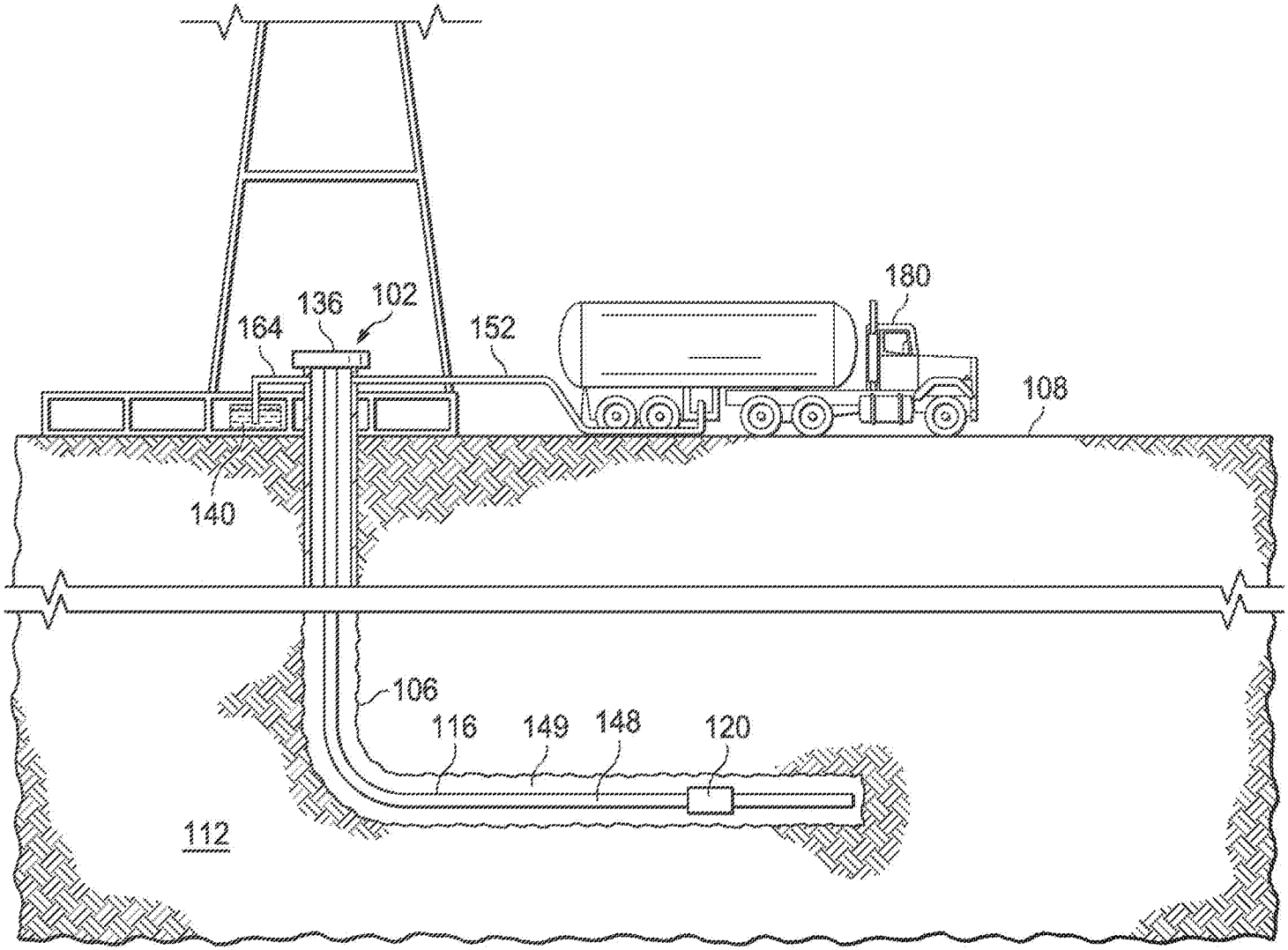
FIG. 1 is a schematic, side view of a borehole during a gravel packing operation.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to gravel pack assemblies, methods to bypass a fluid restrictor during gravel packing operations, and methods to control fluid flow during and after gravel packing operations. A gravel pack assembly having a flow restrictor and a fluid bypass portion is deployed along a downhole string that runs into a borehole of a well. As used herein, the flow restrictor may refer to an inflow control device (ICD), an autonomous inflow control device (AICD), an adjustable ICD, an inflow control valve (ICV), an autonomous inflow control valve (AICV), or another type of tubular or device that restricts fluid flow. Further, and as referred to herein, a downhole string refers to any type of string or conduit that has a cavity that provides a fluid passageway through the cavity. The fluid restrictor forms a fluid passageway from the borehole to an internal cavity of the downhole string. The fluid bypass portion is also coupled to the downhole string and initially forms another fluid passageway from the borehole to the internal cavity, such that during a gravel packing operation, fluids flow through both the passageway through the flow restrictor and the passageway through the fluid bypass portion.

In some embodiments, the gravel pack assembly also includes a screen that filters fluids before the fluids flow through the flow restrictor or the fluid bypass portion. In one or more of such embodiments, the flow restrictor is positioned along one end of the screen and the fluid bypass portion is positioned along an opposite end of the screen. In some embodiments, the fluid restrictor and the fluid bypass portion are housed in the same housing. In some embodiments, the fluid restrictor and the fluid bypass portion are housed in separate housings. In some embodiments, the fluid bypass portion is housed in one or more shunt tubes.

The fluid bypass portion has a sealing member that is inserted into a first chamber and is initially deployed at a location in the first chamber that does not impede fluid flow through the fluid passageway formed by the fluid bypass portion. Examples of sealing members include, but are not limited to, pistons, flappers, gates, or any other component operable to move, in response to a force directed to the sealing member or a change in pressure in the chamber that houses the sealing member, from a first location that does not restrict fluid flow to a second location that restricts fluid flow. In some embodiments, the sealing member has a circular cross-section, D-shaped cross-section, washer-shaped cross-section, tapered cross-section, a varying cross-section, or another cross-sectional shape. In some embodiments, the sealing member is constructed from a variety of materials, including, but not limited to, metal, plastic, ceramic, or glass. In some embodiments, the sealing member extends circumferentially around the string. In some embodiments, the sealing member has elastomeric seals (o-rings) to aid the flow restriction. In some embodiments, the sealing member forms a close fit between non-elastomeric components. The fluid bypass portion also includes an actuation assembly that is triggered after completion of the gravel packing operation to actuate the sealing member. As referred to herein, an actuation assembly is any device or component that is operable to actuate the sealing member. In some embodiments, the actuation assembly is deployed in a second chamber of the fluid bypass portion that is connected to the first chamber and is initially sealed from the first chamber. In one of such embodiments, the fluid bypass portion includes a pressure barrier (e.g., a rupture disc, a burst disc, etc.) that initially seals the first chamber from the second chamber. After completion of the gravel packing operation, the actuation assembly is actuated to penetrate the seal, which generates a negative pressure in the second chamber. The negative pressure in the second chamber relative to the first chamber actuates the sealing member, thereby causing the sealing member to move from an initial position in the first chamber to a second position in the first chamber.

In some embodiments, the actuation assembly includes a device or a component (e.g., a gas emitter) that is operable of initiating a chemical reaction. In one or more of such embodiments, where the actuation assembly includes a gas emitter, the gas emitter is triggered to emit a gas into the first chamber. The gas emitted from the gas emitter generates a positive pressure on the sealing member (or in the first chamber), thereby causing the sealing member to move from an initial position in the first chamber to a second position in the first chamber. In one or more of such embodiments, the actuation assembly sets off a charge (e.g., an explosive charge), which generates a positive pressure on the sealing member to actuate the sealing member. The displacement of the sealing member restricts the fluid passageway through the fluid bypass portion, thereby resulting in only one fluid passageway through the fluid control device. In some embodiments, the actuation assembly features an electrical motor that displaces the sealing member to restrict the fluid passageway. In some embodiments, after actuation of the sealing member, the sealing member partially obstructs the flow. In some embodiments, after actuation of the sealing member, the sealing member completely blocks the flow. Additional descriptions of gravel pack assemblies, methods to bypass a fluid restrictor during gravel packing operations, and methods to control fluid flow during and after gravel packing operations are described in the paragraphs below and are illustrated in FIGS. 1-6.

Turning now to the figures, FIG. 1 is a schematic, side view of a well 102 during a gravel packing operation. In the embodiment of FIG. 1, well 102 has a borehole 106 that extends from a surface 108 of the well 102 to or through a formation 112. A string 116, along with a gravel pack assembly 120, are lowered down borehole 106, i.e. downhole. In one or more embodiments, string 116, or portions of string 116 may be coiled tubing, drill pipe, production tubing, slickline, wirelines, downhole tractor or another type of string operable to deploy gravel pack assembly 120. Although not illustrated, string 116 may include various tubular types and downhole tools (e.g., screens, valves, isolation devices, etc.) used to perform a variety of downhole operations. In the embodiment of FIG. 1, at a wellhead 136, an inlet conduit 152 is coupled to a fluid source (vehicle 180) to provide a fluid passageway for fluids, such as gravel pack slurry, to flow from vehicle 180 to string 116. Moreover, string 116 has an internal cavity that provides a conduit for fluids, such as gravel pack slurry and carrier fluids, to flow from surface 108 downhole. The gravel pack slurry and carrier fluids flow out of string 116 and into an annulus 149 of borehole 106, where the gravel pack slurry is deposited along a section of annulus 149. Carrier fluids that flowed downhole with the gravel pack slurry subsequently flow (e.g., through a flow restrictor or through a fluid bypass portion as described herein) into an internal cavity 148 of string 116, which provides a fluid passageway for the carrier fluids as well as other fluids to flow uphole. In the embodiment of FIG. 1, carrier fluids flow from internal cavity 148 into annulus 149 at a location further uphole, where annulus 149 provides another fluid passageway for the carrier fluids continue to flow uphole until the carrier fluids exit annulus 149 via an outlet conduit 164, and are captured in container 140. In some embodiments, string 116 includes multiple conduits for flowing different types of fluids downhole and for flowing fluids to surface 108. In some embodiments, internal cavity 148 is used for flowing fluids downhole and for flowing fluids from a downhole location to surface 108. In some embodiments, string 116 also transmits signals, such as a signal to actuate a sealing member component of gravel pack assembly 120. In one or more embodiments, string 116 also provides power to gravel pack assembly 120 as well as other downhole components. In one or more embodiments, string 116 also provides downhole telemetry.

FIG. 1 illustrates deployment of one gravel pack assembly 120 along a section of string 116 that runs approximately horizontally across formation 112 (hereafter referred to as the horizontal section of string 116). Gravel pack assembly 120 of FIG. 1 provides at least two fluid flow passageways (not shown) from borehole 106 to internal cavity 148 during gravel packing to facilitate dehydration of the gravel pack slurry, thereby allowing gravel pack to be formed at desired regions of borehole 106. Further, after completion of gravel packing, gravel pack assembly 120 provides one fluid flow passageway from borehole 106, through a fluid restrictor illustrated in FIGS. 2A-4B, to internal cavity 148 to facilitate a more uniform fluid flow throughout string 116 during production, injection, or other post gravel packing operations. In some embodiments, multiple gravel pack assemblies 120 are coupled to different sections of string 116. In some embodiments, gravel packs are installed around gravel pack assembly 120. In some embodiments, gravel packs are installed throughout the horizontal section of string 116. In some embodiments, multiple gravel pack assemblies (not shown) are coupled to different sections of string 116. In some embodiments, gravel pack assembly 120 includes shunt tubes (not shown) to facilitate the distribution of the gravel within the annulus and to provide passage around packers or other zonal isolation devices in the annulus (not shown). Additional description of different embodiments of a gravel pack assembly are illustrated in FIGS. 2A-4B.

Figure 2A:
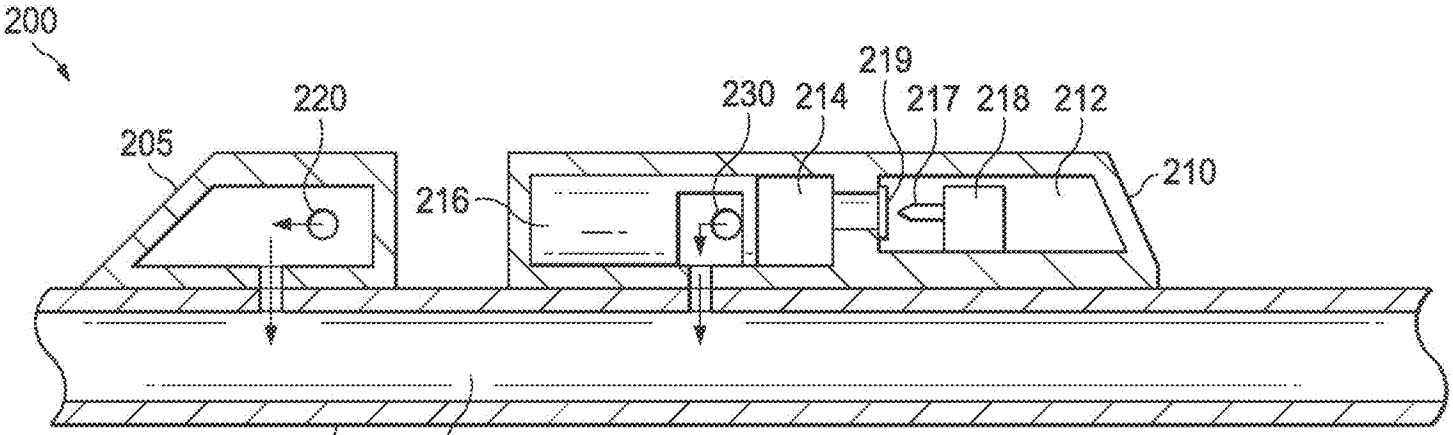
FIG. 2A is a schematic, partial cross-sectional view of a gravel pack assembly during a gravel packing operation.

FIG. 2A is a schematic, partial cross-sectional view of a gravel pack assembly 200 during a gravel packing operation. In the illustrated embodiment of FIG. 2A, gravel pack assembly 200 includes a fluid restrictor 205 and a fluid bypass portion 210. As stated herein, examples of fluid restrictor 205 includes, but are not limited to ICDs, AICDs, adjustable ICDs, ICVs, AICVs, as well as other types of tubulars or devices that restrict fluid flow. In the illustrated embodiment of FIG. 2A, fluid restrictor 205 provides a first fluid passageway from a hole 220 that is fluidly connected to borehole 106, into internal cavity 148 of string 116 of FIG. 1. Further, fluid bypass portion 210 provides a second fluid passageway from a hole 230, through a first chamber 214 of fluid bypass portion 210 into internal cavity 148. In this configuration, hole 230 and hole 220 are in fluid parallel with each other. Fluid bypass portion 210 includes a sealing member 216 that is inserted in first chamber 214. Examples of sealing members include, but are not limited to, pistons, flappers, gates, or any other component operable to move, in response to a force directed to the sealing member or a change in pressure in the chamber that houses the sealing member, from a first location that does not restrict fluid flow to a second location that restricts fluid flow. In the illustrated embodiment of FIG. 2A, sealing member 216 is initially positioned at a location in first chamber 214 that does not restrict the fluid passageway from hole 230, which is also fluidly connected to borehole 106, to internal cavity 148. Fluid bypass portion 210 also includes a second chamber 212 that is initially sealed from first chamber 214 by a pressure barrier 219. In some embodiments, pressure barrier 219 is a burst disc, a rupture disc, or any other device or component that forms a seal between first chamber 214 and second chamber 212. In some embodiments, first chamber 214 is sealed from second chamber 212 during gravel packing operations by a different device, component, or mechanism. In the illustrated embodiment of FIG. 2A, second chamber 212 holds an actuation assembly 218. In the illustrated embodiment, actuation assembly 218 is a battery powered and electronically actuated assembly having a pin pusher 217. In some embodiments, actuation assembly 218 includes a rod, or another protrusion in lieu of pin pusher 217, where upon actuation, the rod or protrusion is driven into pressure barrier 219, thereby breaking the seal between first chamber 214 and second chamber 212. In some embodiments, an actuator component of actuation assembly 218 pulls a component of pressure barrier 219 to break the seal between first chamber 214 and second chamber 212. In some embodiments, actuation assembly 218 includes a timer to determine when the actuation should be initiated. In some embodiments, actuation assembly 218 includes one or more sensors to determine when the gravel pack has been completed, such as a temperature sensor, a pressure sensor, a vibration sensor, a flow sensor, or a fluid composition sensor.

Figure 2B:
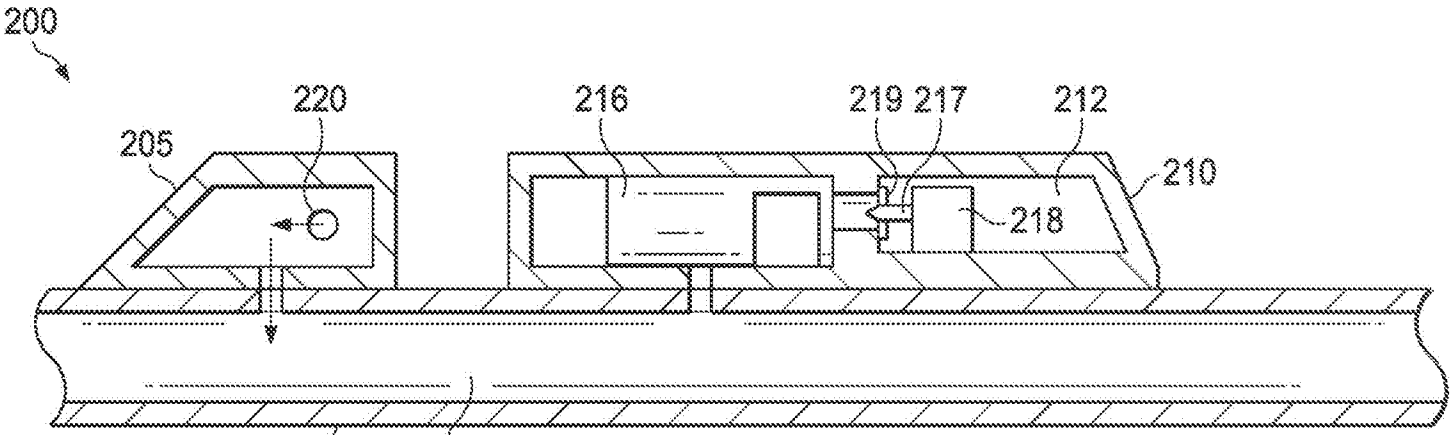
FIG. 2B is a schematic, partial cross-sectional view of the gravel pack assembly of FIG. 2A after completion of the gravel packing operation.

FIG. 2B is a schematic, partial cross-sectional view of the gravel pack assembly 200 of FIG. 2A after completion of the gravel packing operation. In the illustrated embodiment of FIG. 2B, fluid restrictor 205 continues to provide a fluid passageway from borehole 106 of FIG. 1 to internal cavity 148 of string 116 of FIG. 1. However, actuation assembly 218 has been actuated, which caused pin pusher 217 to be driven into pressure barrier 219, thereby penetrating the seal between first chamber 214 and second chamber 212. The penetration of pressure barrier 219 by pin pusher 217 generates a negative pressure (due to presence of fluid in first chamber 214 and absence of fluid in second chamber 212 while second chamber 212 was sealed from first chamber 214) in second chamber 212. The negative pressure in second chamber 212 in turn causes actuation of sealing member 216, thereby displacing sealing member 216 from an initial location illustrated in FIG. 2A to a second location illustrated in FIG. 2B. The displacement of sealing member 216 to its second location also causes sealing member 216 to restrict fluid flow from hole 230, through first chamber 214, into internal cavity 148 of string 116 of FIG. 1, thereby restricting the second fluid passageway. As such, after completion of a gravel packing operation, gravel pack assembly 200 allows fluid restrictor 205 to control fluid flow from borehole 106 to internal cavity 148 by restricting fluid flow through fluid bypass portion 210.

Although FIGS. 2A and 2B illustrate fluid passageways that provide conduits for fluids to flow from borehole 106 of FIG. 1 to internal cavity 148 of string 116 of FIG. 1, in some embodiments, the fluid passageways of FIGS. 2A and 2B are also conduits for fluids to flow from internal cavity 148 into borehole 106. Further, although gravel pack assembly 200 of FIGS. 2A and 2B illustrate having one fluid restrictor 205, in some embodiments, gravel pack assembly 200 includes multiple fluid restrictors (not shown) each providing a fluid passageway from borehole 106 to internal cavity 148 during gravel packing and production operations. Further, although fluid bypass portion 210 of FIG. 2A illustrates one fluid passageway from borehole 106 to internal cavity 148 during a gravel packing operation, in some embodiments, fluid bypass portion 210 includes multiple fluid passageways from borehole 106 to internal cavity 148 during the gravel packing operation. In one or more of such embodiments, first chamber 214 includes multiple holes (not shown), each being fluidly connected to borehole 106. In one or more embodiments, fluid bypass portion 210 includes a third chamber (not shown) similar to first chamber 214 of FIG. 2A, where during the gravel packing operation, fluids flow from a hole (not shown) that fluidly connects borehole 106 to the third chamber, through the third chamber, and into internal cavity 148. Further, actuation of actuation assembly 218, or another actuation assembly, causes blockage of the hole that fluidly connects borehole 106 to the third chamber. In some embodiments, gravel pack assembly 200 also includes a screen (not shown). In one or more embodiments, the screen filters contaminates (e.g., formation sand) from fluids before the fluids flow through hole 220 or hole 230.

Figure 3A:
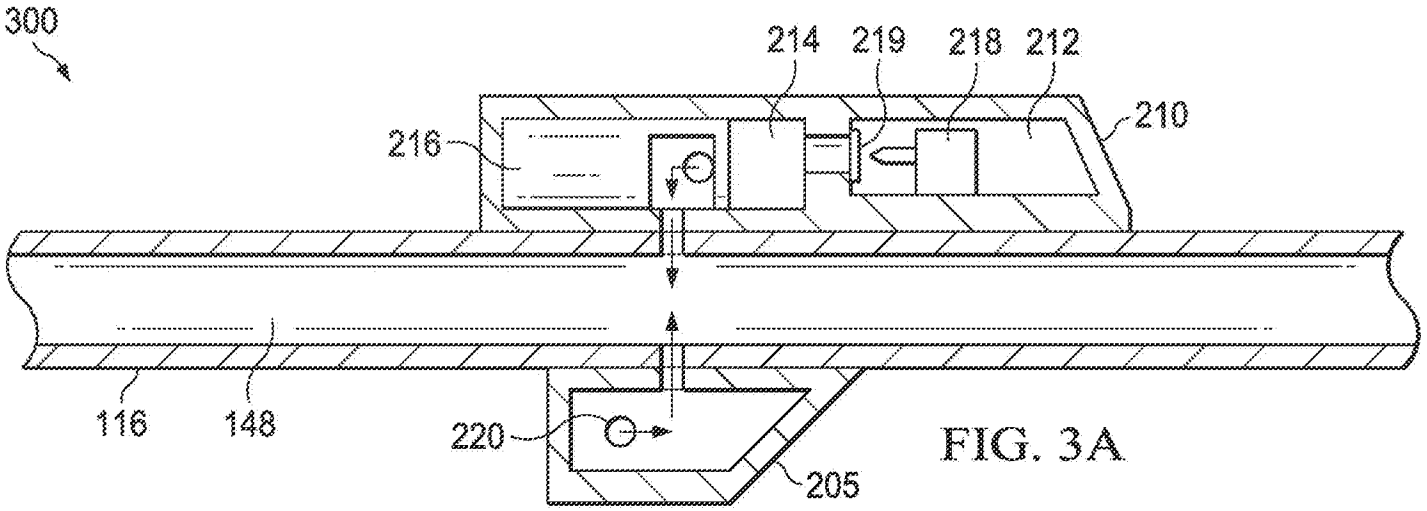
FIG. 3A is a schematic, partial cross-sectional view of another gravel pack assembly during a gravel packing operation.
Figure 3B:
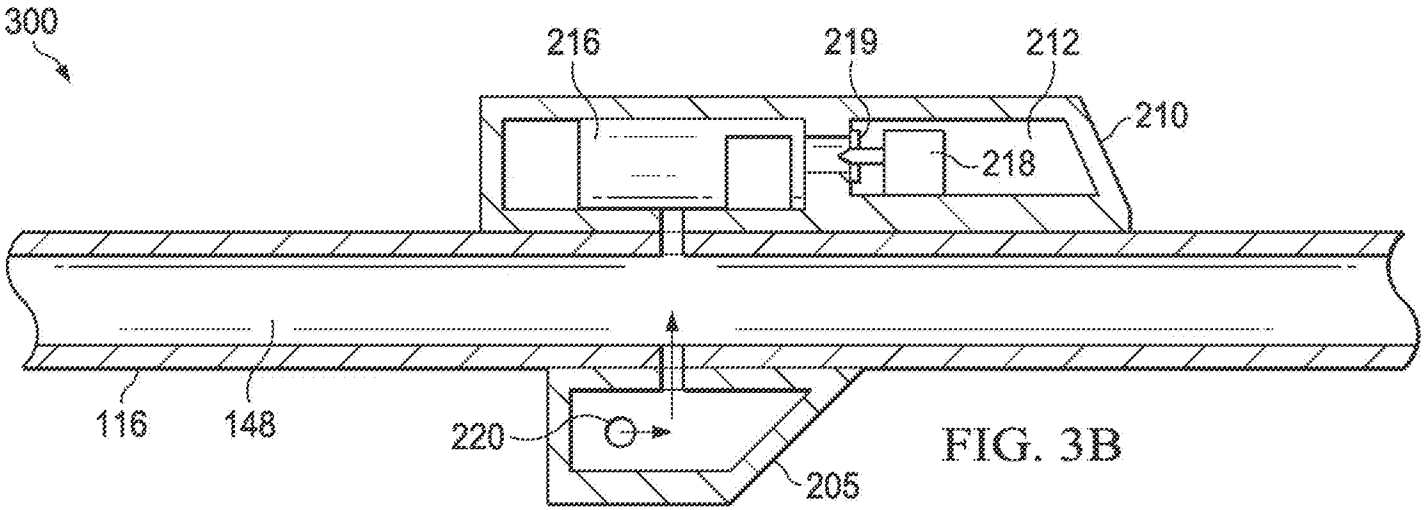
FIG. 3B is a schematic, partial cross-sectional view of the gravel pack assembly of FIG. 3A after completion of the gravel packing operation.

FIGS. 3A and 3B are schematic, partial cross-sectional views of another gravel pack assembly 300 during a gravel packing operation and after completion of the gravel packing operation, respectively. In the illustrated embodiments of FIGS. 3A and 3B, gravel pack assembly 300 includes fluid restrictor 205 and fluid bypass portion 210 of FIGS. 2A and 2B. However, in the illustrated embodiments of FIGS. 3A and 3B, fluid restrictor 205 and fluid bypass portion 210 are housed in the same housing (not shown), whereas in the illustrated embodiments of FIGS. 2A and 2B, fluid restrictor 205 and fluid bypass portion 210 are housed in separate housings (not shown).

Figure 4A:
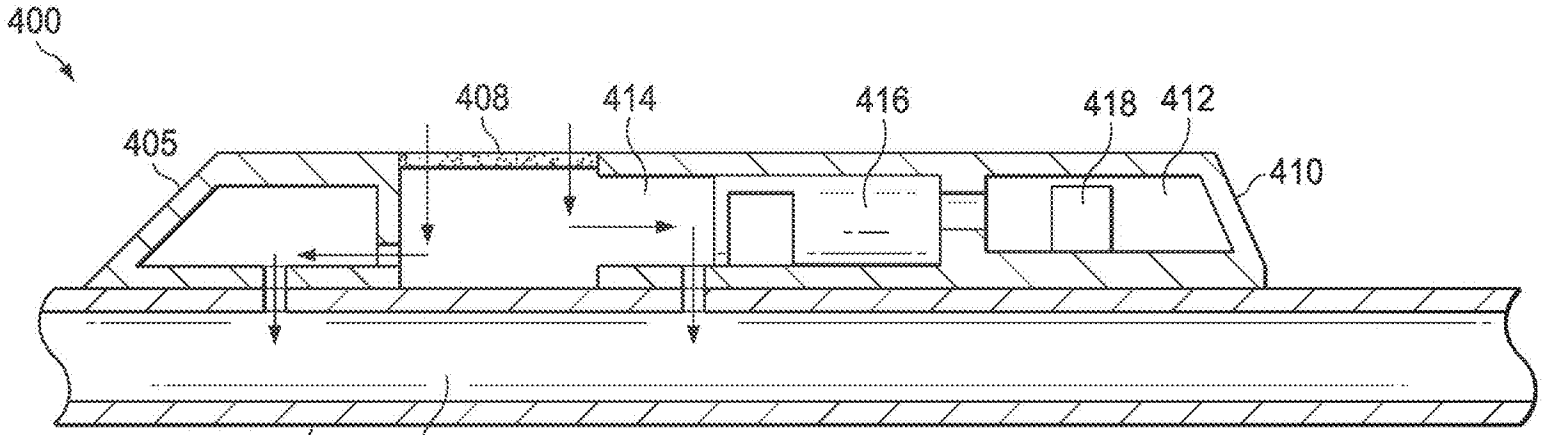
FIG. 4A is a schematic, partial cross-sectional view of another gravel pack assembly during a gravel packing operation.
Figure 4B:
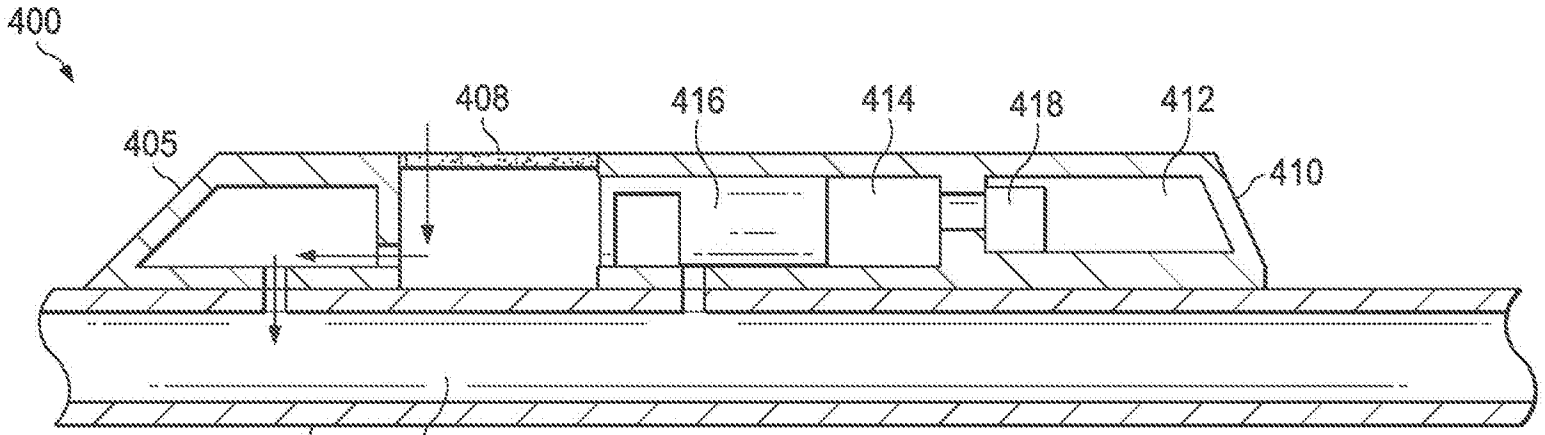
FIG. 4B is a schematic, partial cross-sectional view of the gravel pack assembly of FIG. 4A after completion of the gravel packing operation.

FIG. 4A is a schematic, partial cross-sectional view of a gravel pack assembly 400 during a gravel packing operation. FIG. 4A, similar to FIG. 2A includes a fluid restrictor 405 and a fluid bypass portion 410. FIG. 4A further includes a screen 408 positioned between fluid restrictor 405 and fluid bypass portion 410. In the illustrated embodiment, screen 408 acts as a filter that filters contaminants from fluids before the fluids flow into fluid restrictor 405 or fluid bypass portion 410. As illustrated in FIG. 4A, fluid restrictor 405 provides a first fluid passageway from screen 408 into internal cavity 148 of string 116 of FIG. 1. Further, fluid bypass portion 410 provides a second fluid passageway from screen 408, through a first chamber 414 of fluid bypass portion 410 into internal cavity 148. Fluid bypass portion 410 includes a sealing member 416 that is inserted in first chamber 414. In the illustrated embodiment of FIG. 4A, sealing member 416 is initially positioned at a location in first chamber 414 that does not block the fluid passageway from screen 408, through first chamber 414, and into internal cavity 148. Fluid bypass portion 410 also includes a second chamber 412 that contains an actuation assembly 418. In the illustrated embodiment of FIG. 4A, actuation assembly 418 is operable of generating a positive pressure in first chamber 414. In some embodiments, actuation assembly 418 contains materials that initiate a chemical reaction to generate a gas that expands into first chamber 414. The expansion of gas into first chamber 414 generates pressure on sealing member 416 and displaces sealing member 416 from the sealing member's initial position in first chamber 414 as shown in FIG. 4A to a location of sealing member 416 as shown in FIG. 4B. In some embodiments, actuation assembly 418 contains materials that set off an explosive charge, which exerts a pressure into first chamber 414 and onto sealing member 416. The pressure exerted by the explosive charge displaces sealing member 416. In some embodiments, first chamber 414 is initially sealed from second chamber 412. In one or more of such embodiments, positive pressure generated by actuation assembly 418 (e.g., gas expansion, force generated by an explosive charge, etc.) penetrates the seal that initially separates first chamber 414 from second chamber 412.

FIG. 4B is a schematic, partial cross-sectional view of the gravel pack assembly 400 of FIG. 4A after completion of the gravel packing operation. In the illustrated embodiment of FIG. 4B, fluid restrictor 405 continues to provide a fluid passageway from borehole 106 of FIG. 1 to internal cavity 148 of string 116 of FIG. 1. However, actuation assembly 418 has generated positive pressure on sealing member 416, thereby displacing sealing member 416 from an initial location illustrated in FIG. 4A to a second location illustrated in FIG. 4B. The displacement of sealing member 416 to its second location also causes sealing member 416 to restrict fluid flow from screen 408, through first chamber 414, into internal cavity 148, thereby blocking the second fluid passageway. As such, after completion of the gravel packing operation, gravel pack assembly 400 allows fluid restrictor 405 to control fluid flow from borehole 106 to internal cavity 148. In some embodiments, sealing member 416 is initially held in place with collets, snap rings, or spring-loaded mechanism (not shown). In some embodiments, the force applied to sealing member 416 by actuation of actuation assembly 418 is pressure balanced.

Although FIGS. 4A and 4B illustrate a fluid bypass portion 410 having a first chamber 414 and a second chamber 412, in some embodiments, fluid bypass portion 410 has only one chamber (e.g., first chamber 414). In one or more of such embodiments, both sealing member 416 and actuation assembly 418 are placed in the same chamber. Further, although FIGS. 4A and 4B do not illustrate a pressure barrier, such as pressure barrier 219 of FIGS. 2A, 2B, 3A, and 3B, in some embodiments, gravel pack assembly 400 also includes a pressure barrier that initially seals second chamber 412 from first chamber 414. In one or more of such embodiments, the actuation of actuation assembly 418 also breaks the pressure barrier that initially sealed second chamber 412 from first chamber 414. Further, although gravel pack assembly 400 of FIGS. 4A and 4B includes screen 408, in some embodiments, gravel pack assembly 400 does not include a screen. Further, although gravel pack assembly 400 of FIGS. 4A and 4B illustrate having one fluid restrictor 405, in some embodiments, gravel pack assembly 400 includes multiple fluid restrictors (not shown) each providing a fluid passageway from borehole 106 to internal cavity 148 during gravel packing and production operations. Further, although fluid bypass portion 410 of FIG. 4A illustrates one fluid passageway from borehole 106 to internal cavity 148 during a gravel packing operation, in some embodiments, fluid bypass portion 410 includes multiple fluid passageways from borehole 106 to internal cavity 148 during the gravel packing operation.

Figure 5:
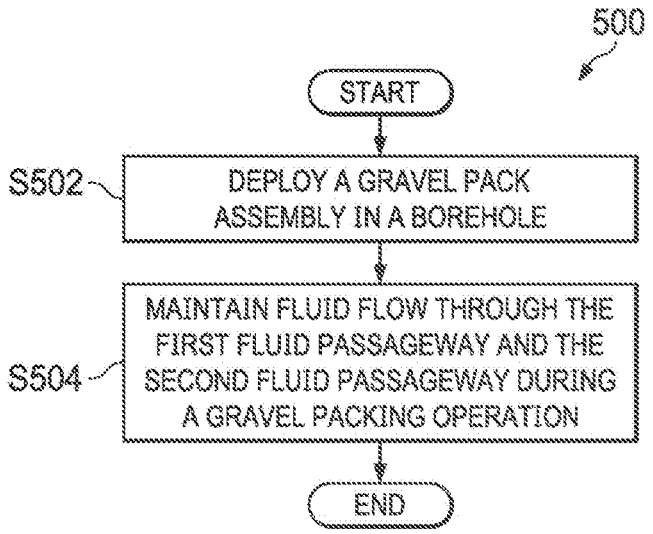
FIG. 5 is a flow chart of a process to bypass a flow restrictor during gravel packing.

FIG. 5 is a flow chart of a process 500 to bypass a flow restrictor during gravel packing. Although the operations in the process 500 are shown in a particular sequence, certain operations may be performed in different sequences or at the same time where feasible.

At block 5502, a gravel pack assembly, such as gravel pack assembly 120, 200, 300, or 400 of FIGS. 1-4B, is coupled to a string, such as string 116 of FIG. 1, and is deployed in a borehole, such as borehole 106 of FIG. 1. The gravel pack includes a flow restrictor that forms a first fluid passageway from the borehole to an internal cavity of the string, such as internal cavity 148 of FIG. 1. As shown in FIG. 2A, flow restrictor 205 provides a fluid passageway from hole 220, which is fluidly connected to borehole 106 of FIG. 1, to internal cavity 148. The gravel pack assembly also includes a fluid bypass portion, such as fluid bypass portion 210 of FIGS. 2A, 2B, 3A, and 3B or 410 of FIGS. 4A and 4B that forms a second fluid passageway from the borehole to the internal cavity of the string. FIG. 2A for example, illustrates fluid bypass portion 210 having a first chamber 214 that forms a second fluid passageway from hole 230, which is fluidly connected to borehole 106, through first chamber 214, into internal cavity 148. The fluid bypass portion has a sealing member inserted into a chamber. FIGS. 2A, 3A, and 4A for example, illustrate sealing member 216 or 416 inserted into first chamber 214 or 414 of fluid bypass portion 210 or 410. The fluid bypass portion also includes an actuation assembly that is operable of actuating the sealing member. FIGS. 2A and 3A, for example, illustrate actuation assembly 218, which when actuated, causes pin pusher 217 to drive into pressure barrier 219, thereby penetrating the seal between first chamber 214 and second chamber 212 of FIGS. 2A and 3A. The penetration of pressure barrier 219 by pin pusher 217 generates a negative pressure, which in turn actuates sealing member 216. FIG. 4A, for example, illustrates actuation assembly 418, which when actuated, sets off an explosive charge or a chemical reaction. Further, pressure generated by the explosive charge or the chemical reaction actuates sealing member 416. In the embodiments of FIGS. 2A-4B, actuation assembly 218 or 418 is stored in a second chamber 212 or 412 of fluid bypass portion 210 or 410. In some embodiments, the actuation assembly and the sealing member are stored in the same chamber.

At block 5504, fluid flow is maintained through the first fluid passageway and the second fluid passageway during a gravel packing operation. FIGS. 2A, 3A, and 4A for example, illustrate maintaining fluid passageways through both fluid restrictor 205 or 405 and fluid bypass portion 210 or 410 during gravel packing operations. In some embodiments, where the gravel pack assembly provides additional fluid passageways from borehole 106 to internal cavity 148, fluid flow through the additional fluid passageways are also maintained during gravel packing operations.

In some embodiments, after completion of the gravel packing operation, the sealing member component of the fluid bypass portion is activated to restrict fluid flow through the second fluid passageway. FIGS. 2B and 3B, for example, illustrate actuating sealing member 216 to block the second fluid passageway from hole 230, through first chamber 214, and into internal cavity 148, as shown in FIGS. 2A and 3A, respectively. Similarly, FIG. 4B, for example, illustrates actuating sealing member 416 to block the second fluid passageway from screen 408, through first chamber 414, and into internal cavity 148.

Figure 6:
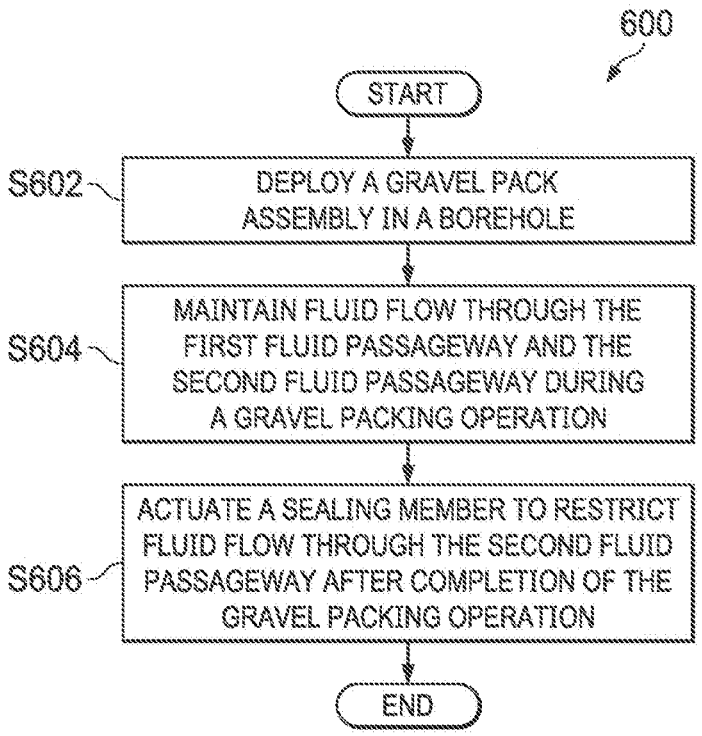
FIG. 6 is a flow chart of a process to control fluid flow during and after a gravel packing operation.

FIG. 6 is a flow chart of a process 600 to control fluid flow during and after a gravel packing operation. Although the operations in the process 600 are shown in a particular sequence, certain operations may be performed in different sequences or at the same time where feasible.

At block 5602, similar to block 5502, a gravel pack assembly, such as gravel pack assembly 120, 200, 300, or 400 of FIGS. 1-4B, is coupled to a string, such as string 116 of FIG. 1, and is deployed in a borehole, such as borehole 106 of FIG. 1. As described herein, the gravel pack assembly initially provides a first fluid passageway through a flow restrictor component and a second fluid passageway through a fluid bypass portion. At block 5604, fluid flow through the first fluid passageway and the second fluid passageway are maintained during a gravel packing operation. At block 5606, and after completion of the gravel packing operation, the sealing member is actuated to restrict fluid flow through the second fluid passageway while fluid flow through the first passageway is controlled by the flow restrictor, such as flow restrictor 205 or 405 of FIGS. 2A-4D.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flow charts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a gravel pack assembly, comprising a flow restrictor coupled to a downhole string that is deployed in a borehole, wherein the flow restrictor forms a first fluid passageway from the borehole to an internal cavity of the string; and a fluid bypass portion comprising a first chamber; a sealing member inserted into the first chamber; and an actuation assembly operable to actuate the sealing member, wherein, the fluid bypass portion forms a second fluid passageway from the borehole to the internal cavity of the downhole string prior to actuation of the actuation assembly, and wherein after actuation of the actuation assembly, fluid flow through the second fluid passageway is restricted by the sealing member.

Clause 2, the gravel pack assembly of clause 1, wherein the actuation assembly further comprises a pressure barrier that initially forms a seal between the first chamber and a second chamber of the fluid bypass portion; and an electronically triggered device housed in the second chamber and operable to penetrate the pressure barrier to actuate the sealing member.

Clause 3, the gravel pack assembly of clause 2, wherein penetration of the pressure barrier generates a negative pressure in the second chamber, and wherein the negative pressure in the second chamber actuates the sealing member.

Clause 4, the gravel pack assembly of clause 2 or 3, wherein the pressure barrier is a rupture disc or a burst disc.

Clause 5, the gravel pack assembly of any one of clauses 1-4, wherein the actuation assembly further comprises a device operable to generate a positive pressure in the first chamber, and wherein the positive pressure in the first chamber actuates the sealing member.

Clause 6, the gravel pack assembly of clause 5, wherein the device is stored in a second chamber of the fluid bypass portion that is initially sealed from the first chamber by a pressure barrier, and wherein the positive pressure generated by the device penetrates the pressure barrier before actuating the sealing member.

Clause 7, the gravel pack assembly of any of clauses 1-6, wherein the flow restrictor and the actuation assembly are housed in an identical housing.

Clause 8, the gravel pack assembly of any of clauses 1-6, wherein the flow restrictor and the actuation assembly are housed in separate housings.

Clause 9, the gravel pack assembly of any of clauses 1-8, further comprising a screen positioned along a section of the string, wherein the flow restrictor is positioned along a first end of the screen, and wherein the fluid bypass portion is positioned along a second end of the screen.

Clause 10, the gravel pack assembly of any of clauses 1-9, wherein the flow restrictor is an inflow control device.

Clause 11, the gravel pack assembly of clauses 1-10, wherein the flow restrictor is an autonomous inflow control device.

Clause 12, a method to bypass a flow restrictor during gravel packing, the method comprising deploying a gravel pack assembly in a borehole, the gravel pack assembly comprising a flow restrictor coupled to a downhole string that is deployed in a borehole, wherein the flow restrictor forms a first fluid passageway from the borehole to an internal cavity of the string; and a fluid bypass portion that forms a second fluid passageway from the borehole to the internal cavity of the string, the fluid bypass portion comprising a first chamber; a sealing member inserted into the first chamber; and an actuation assembly operable to actuate the sealing member; and during a gravel packing operation, maintaining fluid flow through the first fluid passageway and the second fluid passageway.

Clause 13, the method of clause 12, further comprising after completion of the gravel packing operation, actuating the sealing member to restrict fluid flow through the second fluid passageway.

Clause 14, the method of clause 13, wherein the fluid bypass portion comprises a second chamber and a seal between the first chamber and the second chamber, and wherein maintaining the fluid flow comprising maintaining the seal to prevent actuation of the sealing member by the actuation assembly, and wherein actuating the sealing member comprises penetrating the seal to actuate the sealing member.

Clause 15, the method of clause 14, wherein the actuation assembly comprises an electronically triggered device, and wherein penetrating the seal comprises penetrating the seal with the electronically triggered device.

Clause 16, the method of clause 15, further comprising generating a negative pressure in the second chamber, wherein the negative pressure in the second chamber actuates the sealing member.

Clause 17, the method of clause 13, further comprising generating a positive pressure in the first chamber, wherein the positive pressure in the first chamber actuates the sealing member.

Clause 18, a method to control fluid flow during and after a gravel packing operation, the method comprising deploying a gravel pack assembly in a borehole, the gravel pack assembly comprising a flow restrictor coupled to a downhole string that is deployed in the borehole, wherein the flow restrictor forms a first fluid passageway from the borehole to an internal cavity of the string; and a fluid bypass portion that forms a second fluid passageway from the borehole to the internal cavity of the string, the fluid bypass portion comprising a first chamber; a sealing member inserted into the first chamber; and an actuation assembly operable to actuate the sealing member; during a gravel packing operation, maintaining fluid flow through the first fluid passageway and the second fluid passageway; and after completion of the gravel packing operation, actuating of the sealing member to restrict fluid flow through the second fluid passageway.

Clause 19, the method of clause 18, wherein the fluid bypass portion comprises a second chamber and a seal that seals the first chamber from the second chamber, wherein the actuation assembly comprises an electronically triggered device, and wherein actuating the sealing member comprises penetrating the seal with the electronically triggered device; and generating a negative pressure in the second chamber, wherein the negative pressure in the second chamber actuates the sealing member.

Clause 20, the method of clause 18, wherein the actuation assembly comprises a device operable to initiate a chemical reaction, and the method further comprising initiating a chemical reaction to generate a positive pressure in the first chamber, wherein the positive pressure in the first chamber actuates the sealing member.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A gravel pack assembly, comprising:

a flow restrictor coupled to a downhole string that is deployed in a borehole, wherein the flow restrictor forms a first fluid passageway from a first location of the borehole directly into a housing of the flow restrictor, and from the housing of the flow restrictor to a first location of an internal cavity of the string; and a fluid bypass portion comprising:

a first chamber;

a sealing member inserted into the first chamber; and an actuation assembly operable to actuate the sealing member, wherein the fluid bypass portion forms a second fluid passageway from a second location of the borehole directly into a housing of the fluid bypass portion, and from the housing of the fluid bypass portion to a second location of the internal cavity of the downhole string prior to actuation of the actuation assembly, wherein fluid flow through the second fluid passageway is not restricted by the sealing member when the gravel pack assembly is initially deployed downhole and prior to initiation of a gravel pack operation, wherein after actuation of the actuation assembly, fluid flow through the second fluid passageway is restricted by the sealing member, wherein the first location of the borehole and the second location of the borehole are located at different locations, wherein the housing of the flow restrictor and the housing of the bypass portion are separate housings, and wherein the first location of the internal cavity and the second location of the internal cavity are located at different locations.

2. The gravel pack assembly of claim 1, wherein the actuation assembly further comprises:

a pressure barrier that initially forms a seal between the first chamber and a second chamber of the fluid bypass portion; and an electronically triggered device housed in the second chamber and operable to penetrate the pressure barrier to actuate the sealing member.

3. The gravel pack assembly of claim 2, wherein penetration of the pressure barrier generates a negative pressure in the second chamber, and wherein the negative pressure in the second chamber actuates the sealing member.

4. The gravel pack assembly of claim 2, wherein the pressure barrier is a rupture disc or a burst disc.

5. The gravel pack assembly of claim 1, wherein the actuation assembly further comprises a device operable to generate a positive pressure in the first chamber, and wherein the positive pressure in the first chamber actuates the sealing member.

6. The gravel pack assembly of claim 5, wherein the device is stored in a second chamber of the fluid bypass portion that is initially sealed from the first chamber by a pressure barrier, and wherein the positive pressure generated by the device penetrates the pressure barrier before actuating the sealing member.

7. The gravel pack assembly of claim 1, wherein the actuation assembly is housed in a housing of the bypass portion, and wherein the flow restrictor and the actuation assembly are housed in separate housings.

8. The gravel pack assembly of claim 1, wherein the flow restrictor is an inflow control device.

9. The gravel pack assembly of claim 1, wherein the flow restrictor is an autonomous inflow control device.

10. A method to bypass a flow restrictor during gravel packing, the method comprising:

deploying a gravel pack assembly in a borehole, the gravel pack assembly comprising:

a flow restrictor coupled to a downhole string that is deployed in a borehole, wherein the flow restrictor forms a first fluid passageway from a first location of the borehole directly into a housing of the flow restrictor, and from the housing of the flow restrictor to a first location of an internal cavity of the string; and a fluid bypass portion that forms a second fluid passageway from a second location of the borehole directly into a housing of the fluid bypass portion, and from the housing of the fluid bypass portion to a second location of the internal cavity of the string, the fluid bypass portion comprising:

a first chamber;

a sealing member inserted into the first chamber; and an actuation assembly operable to actuate the sealing member; and during a gravel packing operation, maintaining fluid flow through the first fluid passageway and the second fluid passageway, wherein fluid flow through the second fluid passageway is not restricted by the sealing member when the gravel pack assembly is initially deployed downhole and prior to initiation of a gravel pack operation, wherein the first location of the borehole and the second location of the borehole are located at different locations, wherein the housing of the flow restrictor and the housing of the bypass portion are separate housings, and wherein the first location of the internal cavity and the second location of the internal cavity are located at different locations.

11. The method of claim 10, further comprising:

after completion of the gravel packing operation, actuating the sealing member to restrict fluid flow through the second fluid passageway.

12. The method of claim 11, wherein the fluid bypass portion comprises a second chamber and a seal between the first chamber and the second chamber, and wherein maintaining the fluid flow comprising maintaining the seal to prevent actuation of the sealing member by the actuation assembly, and wherein actuating the sealing member comprises penetrating the seal to actuate the sealing member.

13. The method of claim 12, wherein the actuation assembly comprises an electronically triggered device, and wherein penetrating the seal comprises penetrating the seal with the electronically triggered device.

14. The method of claim 13, further comprising generating a negative pressure in the second chamber, wherein the negative pressure in the second chamber actuates the sealing member.

15. The method of claim 11, further comprising generating a positive pressure in the first chamber, wherein the positive pressure in the first chamber actuates the sealing member.

16. A method to control fluid flow during and after a gravel packing operation, the method comprising:

deploying a gravel pack assembly in a borehole, the gravel pack assembly comprising:

a flow restrictor coupled to a downhole string that is deployed in the borehole, wherein the flow restrictor forms a first fluid passageway from a first location of the borehole directly into a housing of the flow restrictor, and from the housing of the flow restrictor to a first location of an internal cavity of the string; and a fluid bypass portion that forms a second fluid passageway from a second location of the borehole directly into a housing of the fluid bypass portion, and from the housing of the fluid bypass portion to a second location of the internal cavity of the string, the fluid bypass portion comprising:

a first chamber;

a sealing member inserted into the first chamber; and an actuation assembly operable to actuate the sealing member;

during a gravel packing operation, maintaining fluid flow through the first fluid passageway and the second fluid passageway; and after completion of the gravel packing operation, actuating of the sealing member to restrict fluid flow through the second fluid passageway, wherein fluid flow through the second fluid passageway is not restricted by the sealing member when the gravel pack assembly is initially deployed downhole and prior to initiation of a gravel pack operation, wherein the first location of the borehole and the second location of the borehole are located at different locations, wherein the housing of the flow restrictor and the housing of the bypass portion are separate housings, and wherein the first location of the internal cavity and the second location of the internal cavity are located at different locations.

17. The method of claim 16, wherein the fluid bypass portion comprises a second chamber and a seal that seals the first chamber from the second chamber, wherein the actuation assembly comprises an electronically triggered device, and wherein actuating the sealing member comprises:

penetrating the seal with the electronically triggered device; and generating a negative pressure in the second chamber, wherein the negative pressure in the second chamber actuates the sealing member.

18. The method of claim 16, wherein the actuation assembly comprises a device operable to initiate a chemical reaction, and the method further comprising initiating a chemical reaction to generate a positive pressure in the first chamber, wherein the positive pressure in the first chamber actuates the sealing member.

19. The gravel pack assembly of claim 1, wherein the actuation assembly and the sealing member are not in physical contact with each other before actuation of the actuation assembly.

20. The gravel pack assembly of claim 1, wherein fluid flow through the second fluid passageway remains unrestricted by the sealing member until a negative pressure actuates the sealing member.

* * * * *